US008203269B2

(12) United States Patent
Boroczki et al.

(10) Patent No.: US 8,203,269 B2
(45) Date of Patent: Jun. 19, 2012

(54) COMPACT METAL HALIDE LAMP WITH SALT POOL CONTAINER AT ITS ARC TUBE ENDPARTS

(75) Inventors: Agoston Boroczki, Budapest (HU); Csaba Horvath, Budapest (HU); Tamas Panyik, Budapest (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/793,470

(22) Filed: Jun. 3, 2010

(65) Prior Publication Data

US 2011/0298365 A1 Dec. 8, 2011

(51) Int. Cl.
*H01J 17/18* (2012.01)

(52) U.S. Cl. ..... 313/623; 313/624; 313/634

(58) Field of Classification Search ..... 313/623–626, 313/493, 634

See application file for complete search history.

(56) References Cited

U.S. PATENT DOCUMENTS

| | | | |
|---|---|---|---|
| 6,646,380 | B1 | 11/2003 | Kubon et al. |
| 6,815,889 | B2 | 11/2004 | Haacke et al. |
| 7,348,731 | B2 | 3/2008 | Haacke et al. |
| 2004/0056600 | A1 | 3/2004 | Lapatovich et al. |
| 2005/0116608 | A1 | 6/2005 | Haacke et al. |
| 2006/0255742 | A1 | 11/2006 | Haacke et al. |

FOREIGN PATENT DOCUMENTS

| | | | |
|---|---|---|---|
| CH | 484 511 | A | 1/1970 |
| DE | 100 12 827 | A1 | 9/2000 |
| EP | 1 174 904 | A1 | 1/2002 |

OTHER PUBLICATIONS

PCT/US2011/038497 International Search Report and Written Opinion (mailed Aug. 31, 2011).

*Primary Examiner* — Vip Patel
(74) *Attorney, Agent, or Firm* — Fay Sharpe LLP

(57) ABSTRACT

A high intensity discharge light source includes an arc tube having a longitudinal axis and a main central discharge chamber formed therein. The arc tube includes first and second electrodes having inner terminal ends spaced from one another along the longitudinal axis. Each electrode extends at least partially into the main central discharge chamber or reaches the end portions of the main central discharge chamber. The arc tube includes first and second sub-chambers located at opposite ends of a main central discharge chamber. The sub-chambers are located entirely axially outward from the inner terminal ends of the electrodes to form cold spot locations for the dose pool outside the main central discharge chamber.

23 Claims, 3 Drawing Sheets

COMPACT METAL HALIDE LAMP WITH SALT POOL CONTAINER AT ITS ARC TUBE ENDPARTS

BACKGROUND OF THE DISCLOSURE

Reference is made to commonly owned, co-pending U.S. patent application Ser. No. 12/793,398, filed Jun. 3, 2010, Ser. No. 12/793,441, filed Jun. 3, 2010, and Ser. No. 12/793,494, filed Jun. 3, 2010.

The present disclosure relates to a compact high intensity discharge lamp and especially to an arc tube for a compact high intensity discharge lamp, and more specifically to an arc tube of a compact metal halide lamp made of translucent, transparent or substantially transparent quartz glass, hard glass, or ceramic arc tube materials. It finds particular application, for example in the automotive lighting field, although it will be appreciated that selected aspects may find application in related discharge lamp environments for general lighting encountering the same issues with regard to salt pool location and maximizing luminous flux emitted from the lamp assembly. For purposes of the present disclosure, a "discharge chamber" refers to that part of a discharge lamp where the arc discharge is running, while the term "arc tube" represents that minimal structural assembly of the discharge lamp that is required to generate light by exciting an electric arc discharge in the discharge chamber. An arc tube also contains the pinch seals with the molybdenum foils and outer leads or lead wires (in the case of quartz arc tubes) or the ceramic protruded end plugs or ceramic legs with the seal glass seal portions and outer leads (in case of ceramic arc tubes) which ensure vacuum tightness of the "discharge chamber" plus the possibility to electrically connect the electrodes in the discharge chamber to the outside driving electrical components via the outer leads pointing out of the seal portions of the arc tube assembly.

High intensity discharge lamps produce light by ionizing a fill, such as a mixture of metal halides, mercury or its replacing buffer alternatives, and an inert gas such as neon, argon, krypton or xenon or a mixture of thereof with an arc passing between two electrodes that extend in most cases at the opposite ends into a discharge chamber and energize the fill in the discharge chamber. The electrodes and the fill are sealed within the translucent, transparent or substantially transparent discharge chamber which maintains a desired pressure of the energized fill and allows the emitted light to pass through. The fill (also known as a "dose") emits visible electromagnetic radiation (that is, light) with a desired spectral power density distribution (spectrum) in response to being vaporized and excited by the arc. For example, rare earth metal halides provide spectral power density distributions that offer a broad choice of high quality spectral properties, including a wide range of color temperatures, excellent color rendering, and high luminous efficacy.

In current high intensity metal halide discharge lamps, a molten metal halide salt pool of overdosed quantity typically resides in a central bottom location or portion of a generally ellipsoidal or tubular discharge chamber, when the discharge chamber is disposed in a horizontal orientation during operation. Since location of the molten salt pool is always at the coldest part of the discharge chamber, this location or spot is often referred to as a "cold spot" location of the discharge chamber. The overdosed molten metal halide salt pool that is in thermal equilibrium with its saturated vapor developed above the liquid dose pool within the discharge chamber, and is located inside the discharge chamber of the lamp at the cold spot area, usually forms a thin liquid film layer on a significant portion of an inner surface of the discharge chamber wall. In this position, the dose pool distorts a spatial intensity distribution of the lamp by increasing light absorption and light scattering in directions where the dose pool is located within the discharge chamber. Moreover, the dose pool alters the color hue of light that passes through the thin liquid film of the dose pool.

Optical designers must address these issues when designing optics around high intensity arc discharge lamps that employ the described arc tube and discharge chamber arrangement. That is, configuration of the optical system must address absorbed, scattered and discolored light rays and the distorted spatial light intensity distribution caused by the distortion effect of the liquid halide dose pool in the discharge chamber. For example, in the past and even in contemporary automotive headlamp constructions, distorted light rays were/are either blocked out, by non light-transparent metal shields, or these light rays were/are distributed in directions that are not critical for the application. In other words, distorted light rays passing through the liquid dose film at the cold spot area of the discharge chamber are generally ignored. As such, this portion of emitted light from the arc discharge represent losses in the optical system since these distorted rays did/do not take part in forming the main beam of the beam forming optical system.

In an automotive headlamp application, for example, the distorted rays are used for slightly illuminating the road immediately preceding the automotive vehicle, or the distorted light rays are directed to road signs well above the road. Due to these losses, efficiency of the headlamp optical systems is typically no higher than approximately 40% to 50%. Optical losses due to beam distortions caused by dose pool in the discharge chamber in lighting systems for other applications may depend on the required beam characteristics, illumination and beam homogeneity levels, and other parameters.

As compact discharge lamps become smaller in wattage and additionally adopt reduced geometrical dimensions, a solution is required with the light source in order to avoid such losses in the optical assembly or system. An improved optical system equipped with discharge lamps of improved beam characteristics would desirably achieve higher illumination levels along with lower energy consumption of the overall lighting system.

Thus, a need exists to address the issues associated with the liquid dose pool located at the cold spot area within the discharge chamber of compact high intensity discharge lamps, and impact of this on performance and efficiency of optical systems designed around these lamps as a result of the uneven and distorted spatial and colorimetric light intensity distribution emitted by these lamps.

SUMMARY OF THE DISCLOSURE

In an exemplary embodiment, an arc tube of a high intensity discharge lamp has first and second electrodes having inner terminal ends spaced from one another to form an arc gap along a longitudinal axis within a main central discharge chamber. Each electrode extends at least partially into the main central discharge chamber or at least reaches reduced diameter end portions of the main central discharge chamber with its inner terminal end. A main central discharge chamber has a configuration that is basically rotationally symmetric about the longitudinal axis. First and second sub-chambers are formed and are located at opposite ends of the main central discharge chamber.

The lamp includes a light transmissive arc tube enclosing the main central discharge chamber and the sub-chambers at opposite ends of the main central discharge chamber. In one embodiment, the first and second sub-chambers are preferably generally spheroidal volume portions located at first and second ends of the main central discharge chamber. The main central discharge chamber is substantially symmetrical about the longitudinal axis and substantially mirror-symmetric relative to a central plane located substantially halfway between the inner terminal ends of the electrodes and which is perpendicular to the longitudinal axis. The first and second sub-chambers are located entirely axially outward of inner terminal ends of the electrodes.

In an exemplary embodiment, the main central discharge chamber has a maximum cross-sectional dimension wider than the first and second sub-chambers at its end.

In another exemplary embodiment, the main central discharge chamber has substantially the same maximum cross-sectional dimension as the first and second sub-chambers at its end.

In another exemplary embodiment, the main central discharge chamber has a substantially smaller maximum cross-sectional dimension than the first and second sub-chambers at its ends. The volumes of the main central discharge chamber and that of the first and second sub-chambers are not separated by a reduced diameter end portions of the main central discharge chamber. The sub-chambers of increased cross-sectional dimension are formed axially outward of the inner terminal ends of the electrodes.

In another exemplary embodiment, only one of the sub-chambers is present at one end of the main central discharge chamber of the lamp. The arc tube assembly of the lamp in this embodiment is asymmetrical relative to a central plane that is located basically halfway between the two inner terminal ends of the electrodes in the main central discharge chamber and perpendicular to the longitudinal axis of the arc tube.

The molten metal halide salt pool or "dose" pool resides in the sub-chambers at a desired cold spot location away from the arc discharge developed between the inner terminal ends of the electrodes within the main central discharge chamber which minimizes potential adverse impact of the dose pool on light luminous flux, spatial intensity distribution, and color emitted from the lamp.

A method of controlling the location of a cold spot in a discharge light source includes providing an arc tube having a longitudinal axis and a main central discharge chamber formed therein. The method further includes orienting first and second electrodes having inner terminal ends spaced from one another to form an arc gap along the longitudinal axis and extending each electrode at least partially into the main central discharge chamber or at least reaching endpoints of the main central discharge chamber with each of the inner terminal ends of the electrodes. A main central discharge chamber is disposed between additional sub-chambers located at each end of the main central discharge chamber and which sub-chambers form the cold spot of the arc tube outside the main central discharge chamber.

In the exemplary embodiments, the method further includes locating the first and second sub-chambers entirely axially outward of inner terminal ends of the electrodes, and preferably in most cases even axially completely outward of the reduced diameter end portions of the main central discharge chamber, and the additional sub-chambers are rotationally symmetric about the longitudinal axis.

A primary benefit of the present disclosure is a controlled location of a liquid metal halide salt pool or dose pool in a compact high intensity discharge lamp.

Another benefit is that the liquid dose pool has less impact on emitted light distribution and its other characteristics, thereby resulting in a more efficient lamp with a more even spatial light intensity distribution. In turn, optical designers can develop a more efficient optical system around a compact high intensity discharge lamp of the newly proposed arc tube architecture.

Still another benefit of providing a preselected liquid dose pool location in the light source is the ability to address the optical quality related problems of absorbed, scattered and/or discolored light rays.

Still other features and benefits of the present disclosure will become more apparent from reading and understanding the following detailed description.

DETAILED DESCRIPTION OF THE PREFERRED EMBODIMENTS

Figure 1:
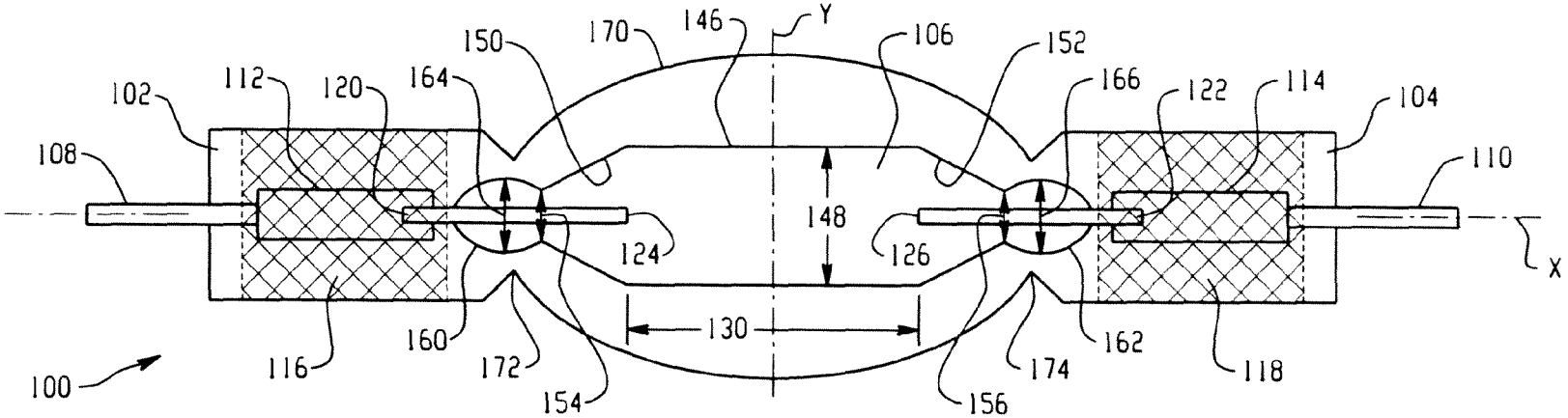
FIGS. 1-5 are longitudinal cross-sectional views of respective embodiments of the present disclosure.

With reference to FIG. 1, a high intensity discharge light source that includes an arc tube 100 in accordance with the exemplary embodiment is shown. First and second pinch seals or sealed ends 102, 104 are disposed at opposite ends of an arc tube. The arc tube is preferably made of a substantially transparent material, such as quartz glass or hard glass arc tube material. Outer leads 108, 110 have outer terminal end portions that extend outwardly from each sealed ends and terminate with its inner terminal ends within the seals, where said outer leads join in mechanical and electrical interconnection with outer terminal end portions of the conductive plates or foils such as a molybdenum foils 112, 114, respectively. The molybdenum foils 112, 114 are entirely embedded within the pinch seal portions 102, 104. First and second electrodes 120, 122 have outer terminal ends that are similarly mechanically and electrically joined with the inner terminal end portions of the molybdenum foils 112, 114. The electrodes 120, 122 include inner terminal end portions 124, 126, respectively, that extend at least partially into the main central discharge chamber 106, that is at least reach reduced diameter end portions of the main central discharge chamber, and the electrodes are separated from one another along a longitudinal axis "X" by an arc gap 130. As is known in the art, in response to a voltage applied between the first and second outer leads, an arc is formed between the inner terminal ends 124, 126 of the electrodes. An ionizable fill material is sealingly received in the discharge chamber of the lamp and reaches a discharge state in response to the voltage applied between the outer leads. Typically, the fill or "dose" includes a mixture of metal halides as well as an inert starting gas or a mixture of thereof. The fill may or may not include mercury as there is an ever-increasing desire to reduce the amount of mercury or entirely remove mercury from the fill.

As described in the Background, in an operational state of the lamp, a liquid phase portion of the dosing material is usually situated in a central bottom portion of a horizontally disposed discharge chamber. This metal halide salt pool or dose pool adversely impacts lamp performance, light color, and has a strong shading effect that impacts spatial light intensity distribution emitted from the lamp. A central portion 146 of the main central discharge chamber extends along a major portion of the chamber in a longitudinal direction. In FIG. 1, the main central discharge chamber of the lamp is preferably substantially rotationally symmetric about the longitudinal axis "X". The main central discharge chamber is also preferably substantially mirror-symmetric relative to a central plane containing a lateral axis "Y" located substantially halfway between the inner terminal ends of the electrodes and which plane is perpendicular to the longitudinal axis "X". As will also be appreciated from FIG. 1, an internal cross-sectional dimension 148 of the main central discharge chamber in this preferred embodiment is substantially constant and the wall thickness varies since the outer surface of the central portion of the arc tube has a generally ellipsoidal conformation about the main central discharge chamber. This constant dimension 148 extends along the region that surrounds the arc gap, i.e., between the terminal ends 124, 126 of the electrodes, and which constitutes a majority of the length of the main central discharge chamber.

In the region surrounding the inner terminal end portion of the electrodes, the main central discharge chamber decreases in cross-sectional dimension. In the particular embodiment of FIG. 1, this decrease in dimension is a generally conical or a tapering reduction 150, 152 in dimension that decreases to a minimum dimension 154, 156 that represent the two endpoints of the main central discharge chamber, respectively. The conical taper 150, 152 at each end substantially begins adjacent the inner terminal ends 124, 126 of the respective electrodes and continues to the minimum dimension 154, 156 located along the length of the electrodes in the main central discharge chamber 106. Located axially outward of the minimum dimensions 154, 156, that is outside the main central discharge chamber of the arc tube, are additional sub-chambers 160, 162, respectively. These sub-chambers constitute cold spot locations of the arc tube and thus form containers for the liquid metal halide salt pools displaced along an axial direction of the arc tube away from the central arc gap region defined between the inner terminal ends of the electrodes, and that are preferably located entirely axially outward of the inner terminal ends of the electrodes as well outward of the main central discharge chamber so as to have a minimal effect on light characteristics emitted by the arc discharge.

FIG. 1 illustrates a particular geometry of the sub-chambers 160, 162 best characterized and described as generally spheroidal portions. The spheroidal sub-chamber portions have maximum cross-sectional dimensions 164, 166 in this embodiment of FIG. 1 which are less than the maximum cross-sectional dimension 148 of the central portion 146 of the main central discharge chamber, but are preferably not less than minimum dimensions 154, 156 representing the endpoints of the main central discharge chamber. These minimum dimensions 154, 156 serve as a connecting passageway between the main central discharge chamber 106 and the sub-chambers 160, 162 but sufficiently segregate the sub-chambers so that the sub-chambers are at a lower temperature than the discharge or arc gap region of the main central discharge chamber. This is advantageous because the liquid dose is only located within the sub-chambers 160, 162 and no liquid dose pool can be found inside the main central discharge chamber 106 or its central portion 146, and in particular no liquid dose pool is located along the arc gap range 130 of the main central discharge chamber. Consequently, no light ray blocking, scattering, or discoloration occurs due to the liquid dose pool and the emitted spatial intensity distribution of the lamp becomes more rotationally symmetric about the longitudinal axis "X" of the arc tube. Further, all of the emitted light can be used by the optical system (not shown) to form a more intense main beam, for example for road illumination in an automotive headlamp equipped with the arc discharge lamp.

A thickness of the sidewall varies along the length of the central portion of the arc tube. Particularly, outer surface 170 of the central portion of the arc tube has a generally ellipsoidal conformation about the main central discharge chamber. Since the central portion 146 of the main central discharge chamber has a substantially constant cross-section, the wall thickness changes from a thicker region along a middle portion and reduces in thickness as the inner surface of the arc chamber progresses along the tapering conical portions 150, 152 toward the sub-chambers 160, 162. Where the ellipsoidal outer surface 170 merges with the legs of the arc tube that form the sealed end portions 102, 104, indents or recesses 172, 174 extend about the periphery of the arc tube at these interfaces. This results in a minimal wall thickness in these regions since the recesses are located between the maximum cross-sectional dimensions 164, 166 of the sub-chambers and the minimum cross-sectional dimensions 154, 156 separating the main central discharge chamber and the sub-chambers. The minimized wall thickness portions act as head conduction barriers in the arc tube wall, which makes the temperature of the sub-chambers even lower and helps in formulating the cold spot locations to be formed in the sub-chambers.

The sub-chambers 160, 162 can be formed by simply moving the pinch sealing zones 116, 118 (shown as cross-hatched areas) within the seal/pinch seal portions 102, 104 of the arc tube away from the main central discharge chamber 106. By moving the sealing zones 116, 118 away from the center, hollow portions of well-defined inner volumes are formed within the tubular arc tube legs outward of the reduced diameter end portions 154, 156 of the main central discharge chamber 106, and more specifically outward of the inner terminal ends of the electrodes 124, 126 within the main central discharge chamber. These hollow portions then constitute the first and second sub-chambers after the sealing operation is performed.

Figure 2:
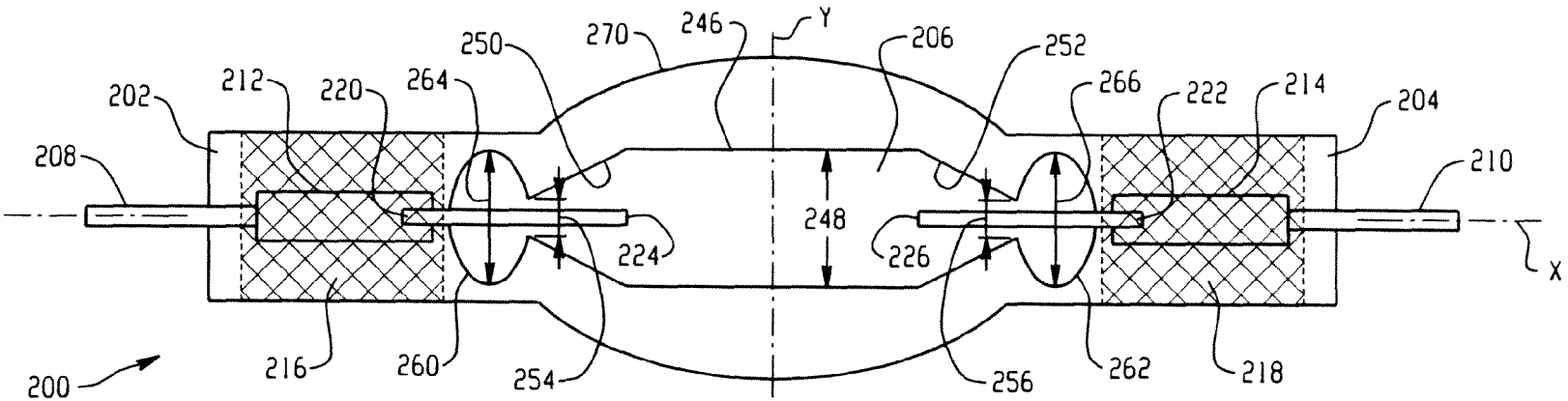

The embodiment of FIG. 2 has many similarities to FIG. 1. Therefore, like reference numerals in the 200-series will refer to like components (for example, arc tube 100 is now referred to as arc tube 200) and otherwise the description from FIG. 1 will apply to FIG. 2 unless specifically noted otherwise. More particularly, in FIG. 2 maximum cross-sectional dimensions 264, 266 of spheroidal sub-chambers 260, 262 are substantially equal to the cross-sectional dimension 248 of the central portion 246 of the main central discharge chamber 206. The minimum dimensions 254, 256 still serve to segregate the sub-chambers 260, 262 from the tapering conical portions 250, 252 of the main central discharge chamber but allow the liquid metal halide dose pool to form in the sub-chambers with minimal impact on the light emitted from the lamp. A comparison of FIGS. 1 and 2 illustrates a shorter axial length of the sub-chambers with a greater cross-sectional dimension. Moreover, no indent/recess is provided at the interface of the outer surface 270 of the ellipsoidal central portion with the legs that form the sealed end portions 202, 204. However, because the maximum cross-sectional dimension of the sub-chambers is increased, the liquid metal dose pool is entirely located in the sub-chambers, that is at a location preferably entirely axially outward of the main central discharge chamber 206, and especially of the terminal ends 224, 226 of the electrodes. Another advantage of increased cross-sectional dimensions of sub-chambers 260, 262 is reduced probability of occurrence of harmful chemical reactions between liquid dose pool in the sub-chambers and metal components in sealing zones 216, 218 due to the fact that total quantity of liquid dose may only partially fill the increased sub-chamber volumes.

Figure 3:
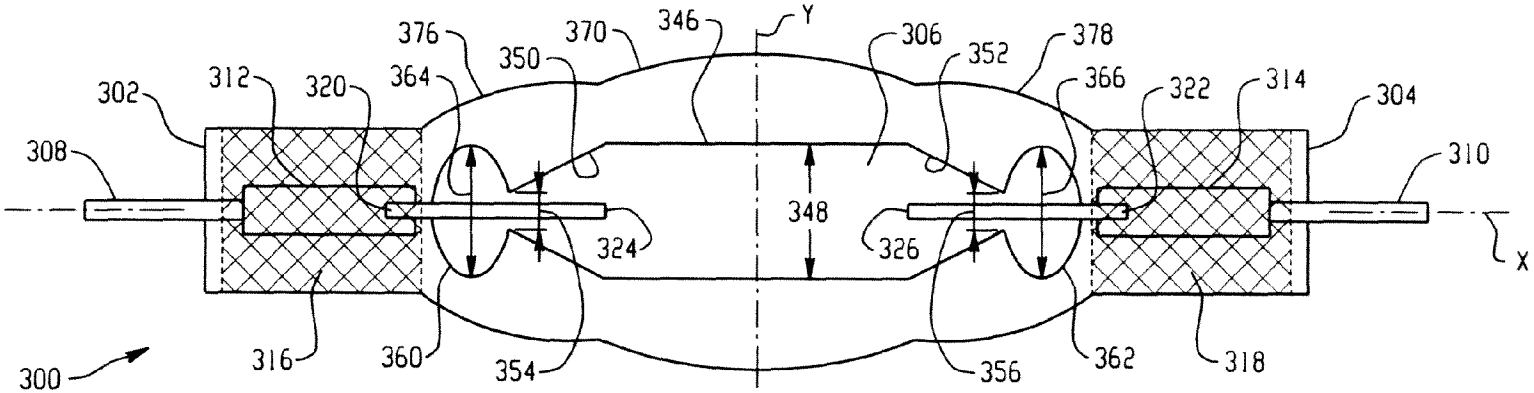

The embodiment of FIG. 3 likewise has many similarities to the exemplary embodiment of FIG. 1 and therefore with FIG. 2. Again, like reference numerals in the 300-series will refer to like components (e.g., arc tube 100 is now identified as arc tube 300), and otherwise the above description will apply unless specifically noted otherwise. In FIG. 3, the spheroidal sub-chambers 360, 362 have a conformation similar to the sub-chambers in FIG. 2 (i.e., axially reduced in length and having a maximum cross-sectional dimension that is substantially identical to the cross-sectional dimension of the central portion 346 of the main central discharge chamber 306). However, the transition between the ellipsoidal surface 370 and the legs of the sealed end portions 302, 304 is slightly modified. Rather than forming indents or recesses as in FIG. 1, the outer surface has an outwardly rounded or convex curvilinear conformation 376, 378. The wall thickness though is still minimized between the outer surface of the arc tube body and the maximum cross-sectional dimension of the sub-chambers so that the temperature is reduced in the sub-chambers relative to the main discharge chamber.

Figure 4:
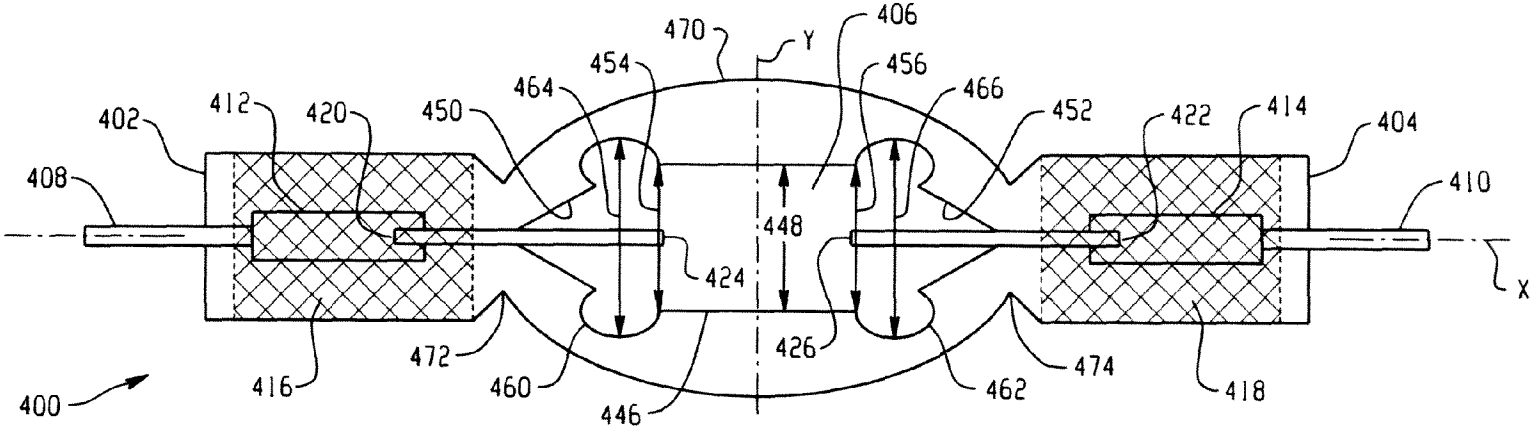

FIG. 4 illustrates a still further manner of trying to control the location of the cold spot within the arc tube by forming sub-chamber portions in it. The embodiment of FIG. 4 has also many similarities to FIG. 1. Therefore, like reference numerals in the 400-series will refer to like components (for example, arc tube body 100 is now referred to as arc tube body 400) and otherwise the description from FIG. 1 will apply to FIG. 4 unless specifically noted otherwise. The embodiment of FIG. 4 is rotationally symmetric about the longitudinal axis of the arc tube 400 and is also mirror-symmetric related to a plane that is about halfway between the inner terminal ends 424, 426 of the electrodes and is perpendicular to the longitudinal axis "X" of the arc tube. A central portion 446 of the main central discharge chamber 406 has a substantially constant maximum cross-sectional dimension 448 forming a substantially cylindrical central portion with an enlarged wall thickness thereabout because of the ellipsoidal shape of the outer surface 470 of the arc tube. As an alternative embodiment, a generally cylindrical outer conformation of the arc tube body may also find a practical realization. At regions spaced axially outward from each inner terminal end 424, 426 of the electrodes 420, 422 are enlarged diameter cavity portions 460, 462 that constitute the first and second sub-chambers that terminate at locations spaced axially outward of each terminal end of a respective electrode, and prior to converging, substantially conical areas 450, 452 that taper inwardly from the outside sub-chamber ends. In an alternative embodiment the substantially conical areas 450, 452 are completely left out and the sub-chambers 460, 462 extend until the points where electrodes 420, 422 extend to the chamber.

In sub-chambers 460, 462, the diameter of the set of multiple discharge chambers consisting of the main central discharge chamber and the two sub-chambers is maximized, the temperature of the inner wall is minimized, and thus the sub-chambers form cold spot locations for the liquid dose pool that is in this way to be contained in any or each of the sub-chambers. The dose passageway portions with minimum dimensions 454, 456 of the previous embodiments are completely omitted, that is their diameter is substantially the same as the diameter 448 of the center portion of the main central discharge chamber.

The sub-chambers 460, 462 containing the liquid dose pool and adjoining the end of the main central discharge chamber are advantageous because there is basically light generated outwardly from the inner terminal ends of the electrodes (the arc gap) and therefore there is no adverse impact on light quality emitted by the lamp. On the other hand, at the central portion 446 of the main central discharge chamber 406 where the arc discharge is running between the inner terminal ends 424, 426 of the electrodes, the inner wall of the chamber is clear and has no liquid dose on its inner surface. Consequently, no light absorption, scattering, or discoloration occurs in the central arc chamber portion 446, either. In addition, the sub-chambers, being outside the arc gap region, have no or only very small effect on arc discharge operation.

Figure 5:
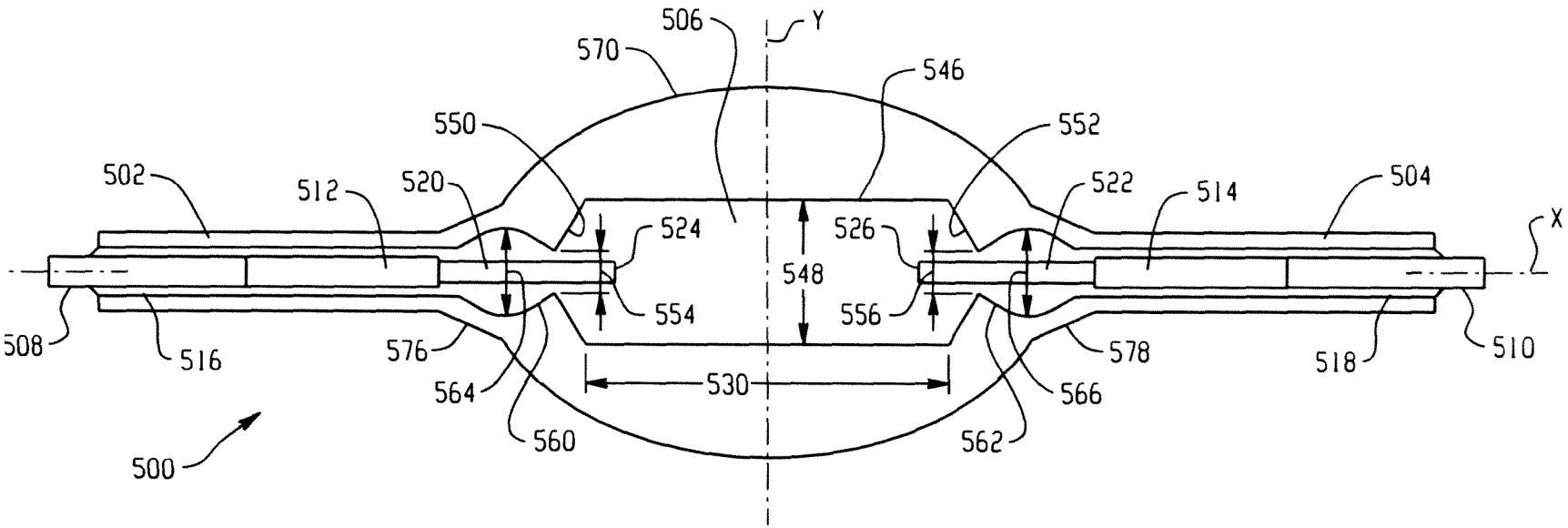

The embodiment of FIG. 5 likewise has many similarities to the exemplary embodiments of FIG. 1 through FIG. 3. Again, like reference numerals in the 500-series will refer to like components (e.g., arc tube 300 of FIG. 3 is now identified as arc tube 500), and otherwise the above description will generally apply unless specifically noted otherwise. The basic difference between the embodiments of FIG. 3 and FIG. 5 is now related to the differences in arc tube making technologies of the two embodiments. The embodiment of FIG. 3 is based on a quartz glass or hard glass high intensity discharge lamp arc tube making technology. In contrast, the embodiment of FIG. 5 is based on a translucent, transparent or substantially transparent ceramic based high intensity discharge lamp (ceramic metal halide lamp) arc tube making technology.

As a consequence, no exact correspondence exists between the arc tube components of the two embodiments which is particularly reflected in the alternations of the structure of electrodes and connected outer leads, and the structure of the sealing portions of the arc tubes of the two embodiments. As an example, molybdenum sealing foils 312, 314 in the embodiment of FIG. 3 are replaced with halide resistant components 512, 514 of substantially cylindrical geometry in the embodiment of FIG. 5. Similarly, flat sealing portions 302, 304 of glass based arc tube production technology are replaced by substantially cylindrical sealing legs 502, 504 in FIG. 5 in accordance with the ceramic arc tube production technology. It is to be noted, however, that the principal concept of the present disclosure, or more specifically the existence of a main central discharge chamber and one or two sub-chambers adjacent to its one or both ends, is independent of the arc tube production technologies applied.

In FIG. 5, the spheroidal sub-chambers 560, 562 have a conformation similar to the sub-chambers in FIG. 1 (i.e., axially reduced in length and having a maximum cross-sectional dimension 564, 566 that is substantially smaller to the cross-sectional dimension 548 of the central portion 546 of the main central discharge chamber 506). However, the transition between the ellipsoidal surface 570 and the legs of the sealed end portions 502, 504 is slightly modified. Rather than forming indents or recesses as in FIG. 1, the outer surface has an outwardly rounded or convex curvilinear conformation 576, 578 as in FIG. 3. The wall thickness though is still minimized between the outer surface of the arc tube body and the maximum cross-sectional dimension of the sub-chambers so that the temperature is reduced in the sub-chambers relative to the main discharge chamber. Sealing zones 516, 518 are made of a metal-oxide based and crystalline phase sealing material (seal glass or sealing fit) according to the ceramic arc tube production technology. The locations of these sealing zones are always at the end portions of the sealing legs in this technology, so the forming process of the sub-chambers is related to the production process of the ceramic arc tube itself, and should not be directly connected to the position of these sealing zones, in contrast to the case of the glass based arc tube production technology.

In summary, one or both ends of the main central discharge chamber of the arc tube include sub-chamber(s) formed around the base regions of the electrodes (i.e., at the region where the electrodes contact and are sealed in the arc tube seal end portions). In the preferred embodiments, and especially in the case of applying a glass based arc tube production technology, the small sub-chambers are formed by moving the sealing zone of the pinch seal section away from the end parts of the main central discharge chamber along the axis of the exhaust tubes or arc tube legs adjoining at one or both ends of the central portion of the arc tube. In this way, a well-defined portion of the exhaust tube(s) adjoining the main central discharge chamber stays hollow, forming sub-chamber(s) at the end(s) of the main central discharge chamber. Alternatively, especially in the case of applying a ceramic based arc tube production technology, the small sub-chamber (s) can be formed as an integral part of the arc tube forming process, itself. The small sub-chamber(s) is (are) colder than any part of the main central discharge chamber since only the conducted heat across the electrode(s) and the wall heats these regions and not direct radiation from the arc discharge. Consequently, a major or full quantity of the liquid metal halide dose pool is located within this (these) small sub-chamber(s) since this (these) sub-chamber(s) constitutes the cold spot area(s) of the arc tube. As a result, no liquid dose is found in the main central discharge chamber or at least at its central portion between the inner terminal ends of the opposing electrodes, the light rays are not blocked, and no scattering or discoloration occurs as in prior art arrangements where the dose pool is located in the central portion of the discharge chamber. The spatial light intensity distribution of the light emitted by the lamp becomes more spatially symmetric and all of the light emitted by the arc discharge can be used by the optical system to form a more intense main beam. In this way, lamp power consumption can be reduced while still delivering high illumination levels.

For example, for automotive headlighting applications, smaller headlamps with lower energy consumption (e.g, using a 25 W high intensity discharge lamp instead of the conventional 35 W type) can be designed while still keeping road illumination above halogen incandescent levels. Smaller energy consumption of a lamp or the complete lighting system does not only leads to reduced $CO_2$ emission levels, but also offers the opportunity of a full lamp-electronics system integration, due to the reduced heat dissipation of the system. Potentially overall system cost can be reduced by 30-45% since no washing and leveling equipment is required below 2000 lumens lamp luminous flux. As another application example, more even lamp performance can be achieved in the case of universal burning orientation of a high intensity discharge lamp for general lighting since the liquid dose pool always sits at the end or completely outside of the main central arc chamber of the lamp (that is, in the sub-chambers) irrespective of the lamp orientation.

The disclosure has been described with reference to the preferred embodiments. Obviously, modifications and alterations will occur to others upon reading and understanding the preceding detailed description. It is intended that this disclosure be construed as including all such modifications and alterations.

Having thus described the invention, it is now claimed:

1. A high intensity discharge light source comprising:

an arc tube having a longitudinal axis and a main central discharge chamber fowled therein;

first and second electrodes having inner terminal ends spaced from one another along the longitudinal axis and each electrode extending at least partially into the main central discharge chamber or at least reaching reduced diameter end portions of the main central discharge chamber with its inner terminal end;

first and second sub-chambers disposed at opposite, first and second axial ends of the main central discharge chamber, each sub-chamber located entirely axially outward of the inner terminal ends of the electrodes, wherein the main central discharge chamber has a cross-sectional dimension substantially the same as or wider thancross-sectional dimensions of the first and second sub-chambers;

a reduced dimensional region adjacent each end of the main central discharge chamber that separates the respective first and second sub-chambers from the main central discharge chamber; and first and second sealing portions at opposite, first and second axial ends of the arc tube.

2. The high intensity discharge light source of claim 1, wherein the sub-chambers have generally spheroidal conformations.

3. The high intensity discharge light source of claim 2, wherein the main central discharge chamber has smaller cross-sectional dimension than the first and second sub-chambers.

4. The high intensity discharge light source of claim 1, wherein there is only one of first and second sub-chambers is present and making the arc tube of the lamp asymmetrical relative to a central plane that is located basically halfway between the two inner terminal ends of the electrodes in the main central discharge chamber and being perpendicular to the longitudinal axis of the arc tube.

5. The high intensity discharge light source of claim 1, wherein the wall of the arc tube has a substantially constant wall thickness along the length of the central portion of the arc tube between the first end to the second end sealing portions.

6. The high intensity discharge light source of claim 1 wherein the arc tube has a different wall thickness along the length of the main central discharge chamber than around the first and second sub-chambers.

7. The high intensity discharge light source of claim 1 wherein the discharge chamber portion of the arc tube is substantially symmetrical about the longitudinal axis.

8. The high intensity discharge light source of claim 1 wherein the discharge chamber portion of the arc tube is substantially mirror-symmetric relative to a plane located halfway between the inner terminal ends of the electrodes and perpendicular to the longitudinal axis.

9. A method of controlling a location of a cold spot in a high intensity discharge light source comprising:

providing an arc tube having a longitudinal axis and a main central discharge chamber formed therein;

orienting first and second electrodes having inner terminal ends spaced from one another along the longitudinal axis and each electrode extending at least partially into the main central discharge chamber or at least reaching reduced diameter end portions of the main central discharge chamber with its inner terminal end;

forming first and second sub-chambers at opposite ends of a main central discharge chamber, wherein the sub-chambers are located entirely axially outward of the terminal ends of the electrodes, wherein the main central discharge chamber has a cross-sectional dimension substantially the same as or wider than cross-sectional dimensions of the first and second sub-chambers;

forming a reduced dimensional region adjacent each end of the main central discharge chamber that separates the first and second sub-chambers from the main central discharge chamber; and providing first and second sealing portions at opposite, first and second axial ends of the arc tube.

10. The method of claim 9 further comprising forming the sub-chambers in a generally spheroidal conformation.

11. The method of claim 9 further comprising forming the main central discharge chamber to be slightly smaller in cross-sectional dimension than the first and second sub-chambers.

12. The method of claim 9 further comprising forming the arc tube of the lamp to have only one of first and second sub-chambers present and to make the arc tube to be asymmetrical relative to a central plane that is located basically halfway between the two inner terminal ends of the electrodes in the main central discharge chamber and being perpendicular to the longitudinal axis of the arc tube.

13. The method of claim 9 further comprising forming a substantially constant wall thickness along the length of the central portion of the arc tube between the first end to the second end sealing portions.

14. The method of claim 9 further comprising forming the wall thickness along the length of the main central discharge chamber to be different from the first and second sub-chamber wall thicknesses.

15. The method of claim 9 further comprising forming the discharge chamber portion of the arc tube to be substantially symmetrical about the longitudinal axis.

16. The method of claim 9 further comprising forming the discharge chamber portion of the arc tube to be substantially symmetrical relative to a plane located halfway between the inner terminal ends of the electrodes and perpendicular to the longitudinal axis.

17. The method of claim 9 further comprising forming a reduced dimensional region adjacent each end of the main central discharge chamber that separates the sub-chamber from the main central discharge chamber.

18. An automotive discharge lamp comprising:

a light transmissive arc tube enclosing a main central discharge chamber;

inner terminal ends of first and second electrodes at least partially received in the main central discharge chamber or adjacent to it and are separated by an arc gap;

first and second sub-chambers located at first and second ends of the main central discharge chamber, the chamber being substantially symmetrical about the longitudinal axis and substantially mirror-symmetric relative to a plane located halfway between the inner terminal ends of the electrodes and perpendicular to the longitudinal axis; and wherein the first and second sub-chambers extend axially to inner terminal ends of the electrodes.

19. The automotive discharge lamp of claim 18, wherein a main central discharge chamber is slightly wider in cross-sectional dimension than the first and second sub-chambers.

20. The automotive discharge lamp of claim 18, wherein a main central discharge chamber is similar in cross-sectional dimension to sub-chambers.

21. The automotive discharge lamp of claim 18 wherein a main central discharge chamber is slightly smaller in cross-sectional dimension to sub-chambers.

22. The automotive discharge lamp of claim 18 wherein there is only one of first and second sub-chambers is present.

23. The automotive discharge lamp of claim 18, wherein a wall thickness along the length of the main central discharge chamber is different than a wall thickness around the first and second sub-chambers.

* * * * *